US007571604B2

(12) United States Patent
Vigholm et al.

(10) Patent No.: US 7,571,604 B2
(45) Date of Patent: Aug. 11, 2009

(54) METHOD FOR SHAKING A WORK IMPLEMENT

(75) Inventors: Bo Vigholm, Stora Sundby (SE); Nils-Erik Bånkestad, Eskilstuna (SE); Rauno Räisanen, Eskilstuna (SE)

(73) Assignee: Volvo Contruction Equipment AB, Eskilstuna (SE)

( * ) Notice: Subject to any disclaimer, the term of this patent is extended or adjusted under 35 U.S.C. 154(b) by 0 days.

(21) Appl. No.: 11/550,988

(22) Filed: Oct. 19, 2006

(65) Prior Publication Data

US 2007/0039457 A1 Feb. 22, 2007

Related U.S. Application Data

(63) Continuation of application No. PCT/SE2005/000466, filed on Mar. 29, 2005.

(30) Foreign Application Priority Data

Apr. 19, 2004 (SE) ..... 0401029

(51) Int. Cl.
*E02F 9/22* (2006.01)
*G05B 15/00* (2006.01)

(52) U.S. Cl. ..... 60/445; 700/75

(58) Field of Classification Search ..... 60/445, 60/459, 469; 700/75, 85
See application file for complete search history.

(56) References Cited

U.S. PATENT DOCUMENTS

| | | | | |
|---|---|---|---|---|
| 5,235,809 | A * | 8/1993 | Farrell | 60/445 |
| 5,765,594 | A | 6/1998 | Collins et al. | |
| 5,880,957 | A | 3/1999 | Aardema et al. | |
| 6,029,445 | A | 2/2000 | Lech | |
| 6,047,228 | A | 4/2000 | Stone et al. | |
| 6,757,992 | B1 * | 7/2004 | Berger et al. | 701/50 |
| 6,763,661 | B2 * | 7/2004 | Tabor et al. | 60/327 |
| 6,895,319 | B2 * | 5/2005 | Alexander et al. | 701/50 |
| 2002/0065575 | A1 * | 5/2002 | Francis et al. | 700/173 |

* cited by examiner

*Primary Examiner*—Thomas E Lazo
(74) *Attorney, Agent, or Firm*—Novak Druce + Quigg LLP

(57) ABSTRACT

A method and arrangement for controlling a function of a work implement utilizing a device including a source of pressurized fluid (1), a circuit of pressurized fluid (2) for driving the work implement, an electronically controlled hydraulic valve (5) being arranged in the circuit of pressurized fluid (2) for controlling the function of the work implement, a control unit (4) for controlling the hydraulic valve (5) based upon a signal from a control member (3) for transmitting a control command to the control unit (4), wherein the control unit (4) is arranged for controlling the hydraulic valve (5) in accordance with a smooth mode function or an abrupt mode function. The opening time for opening the hydraulic valve (5) to a predetermined opening degree is changed when switching from one operating mode function to the other operating mode function.

19 Claims, 2 Drawing Sheets

METHOD FOR SHAKING A WORK IMPLEMENT

CROSS-REFERENCE TO RELATED APPLICATIONS

The present application is a continuation patent application of International Application No. PCT/SE2005/000466 filed 29 Mar. 2005 which is published in English pursuant to Article 21(2) of the Patent Cooperation Treaty and which claims priority to Swedish Application No. 0401029-4 filed 19 Apr. 2004. Said applications are expressly incorporated herein by reference in their entireties.

FIELD

The present invention relates to a method for controlling a function of a work implement by means of a device including a source of pressurized fluid, a circuit of pressurized fluid for driving the work implement, an electronically controlled hydraulic valve being arranged in the circuit of pressurized fluid for controlling the function of the work implement, a control unit for controlling the hydraulic valve based upon a signal from a control member for transmitting a control command to the control unit, wherein the unit is arranged for controlling the hydraulic valve in accordance with a smooth mode function or an abrupt mode function.

Furthermore, the invention relates to a computer program product, being arranged for implementing the method according to the invention on a working machine being provided with said work implement and said device.

The invention is applicable to working machines in general. It is particularly preferred for loading machines. For the purpose of exemplification, such an application will be described in the following. The work implement can be any work implement, but is preferably a bucket of a loading machine. A number of different operating functions can be controlled in the way and with the means being specified by the invention. However, for the purpose of exemplification, the tilt function or shaking function, of a loader or earthmover bucket will be described.

BACKGROUND

When using electro-hydraulics in machines being provided with buckets, for example loaders, earthmovers and power shovels, normally a control signal being generated by an operator via a control member is used for the bucket control. Thereby, a computer or a control unit is arranged for manipulating the signal and ensuring smooth operation in normal conditions. Therefore, when a valve being used for the bucket control or the like is activated, the acceleration and deceleration of the bucket normally are reduced in order to give smooth starts and stops, improved stability, less fatigue stress on the mechanical structure and on the hydraulics. This causes a problem, however, when the bucket is to be cleaned by means of shaking.

In conventional machines, the operator usually moves the bucket rapidly back and forth in order to shake dirt out of the bucket in this way. This movement of the bucket is triggered by the operator moving a control lever rapidly back and forth, normally the regular bucket tilt lever.

From U.S. patent application US 2002/0065575, Francis et al., it is known with a bucket shakeout mechanism for electro-hydraulic machines. According to US 2002/0065575, the bucket shakeout mechanism includes a mode control module, being stored on a memory device and comprising a smooth mode module and an abrupt mode module. The abrupt mode module can be activated by means of a special manipulation of a control lever or a joystick controller. When activating the abrupt mode module, the control lever characteristics are changed, so that a given control lever displacement results in another opening response of the hydraulic valve being used for the shaking than what is the case with the corresponding control lever displacement when the smooth mode module is activated. It may also be looked upon as the signal characteristics being changed depending on the selected operating mode module.

Accordingly, according to the above-described publications, a given set of control parameters is changed when switching from one operating mode module to another. In this case, the change consists in the opening degree value of the hydraulic valve being increased for a given control lever displacement value, or that the maximum opening degree of the hydraulic valve is increased when switching from smooth mode operation to abrupt mode operation.

SUMMARY

One object of the present invention is to provide an alternative method which can be used for controlling the tilt function of a working machine bucket or the like and which provides the desired fast response, speed, in abrupt mode operation, and the desired slow response in smooth mode operation. The response is defined by the rate at which a certain quantity of hydraulic fluid passes through a hydraulic valve in order to achieve a displacement of the work implement in question, typically being constituted of the bucket of a loading machine.

The object of the invention is achieved by means of the method mentioned by way of introduction, characterized in that the opening time for opening the hydraulic valve to a predetermined opening degree is changed when switching from one operating mode function to another operating mode function. In other words, a given set of control parameters is changed when switching from one operating mode function to another, in so far as the ramp time, the time being provided for opening the hydraulic valve to a given opening degree, is changed in connection with the switch over.

For the opening time for opening the hydraulic valve to a predetermined opening degree is reduced when switching from smooth mode function to abrupt mode function.

According to one embodiment, also the maximum opening degree of the hydraulic valve is changed when switching from one operating mode function to the other. In other words, it is not only the ramp time, but also the opening degree, which are changed, resulting in double advantages, since a given flow through the valve is achieved faster, as well as a larger flow towards the end of the opening.

According to the invention it is possible that the opening degree of the hydraulic valve, which corresponds to a given position of the control member, is changed when switching from one operating mode function to the other.

It should be appreciated that the opening degree is increased when switching from the smooth mode function to the abrupt mode function.

According to a preferred embodiment, the control member is a control lever, being adapted to be brought manually from a starting position to a displacement angle ($\alpha$), and the opening degree of the hydraulic valve is determined by the displacement angle ($\alpha$). It is also conceivable that the hydraulic valve is opened to a given opening degree independently of the displacement angle ($\alpha$), as a response to the control unit having received a command to switch over to abrupt mode operation and that, accordingly, also a very small tilt of the lever thereby would result in a sufficient and predetermined opening degree. It should be appreciated that the expression control lever also includes what is called a joystick in everyday speech. The selection of operating mode function is preferably done by the control unit based upon the speed or frequency at which the control member is moved back and forth by an operator.

According to the invention, the pressure level being delivered by the source of pressurized fluid for driving the work implement can be increased when switching from smooth mode function to abrupt mode function. This can be accomplished simply by means of the control unit allowing a higher pressure from a hydraulic pump of the working machine to act on the fluid flowing through the hydraulic valve when receiving a command to operate in abrupt mode. This can be accomplished either by means of controlling a pressure regulator upstream the hydraulic valve or by means of a direct control of the output of said pump.

The invention also includes an electro-hydraulic machine that is characterized in that it includes a device and a computer program product as defined in the foregoing. Preferably, the machine is loading machine, the work implement is a tiltable bucket and the operating function is a bucket tilt function.

Additional features and advantages of the present invention will become apparent from the following detailed description of embodiments and from the appended claims.

BRIEF DESCRIPTION OF THE DRAWINGS

With the purpose of exemplification, the invention be described in greater detail in the following with reference to the appended drawings, in which.

DETAILED DESCRIPTION

Figure 1:
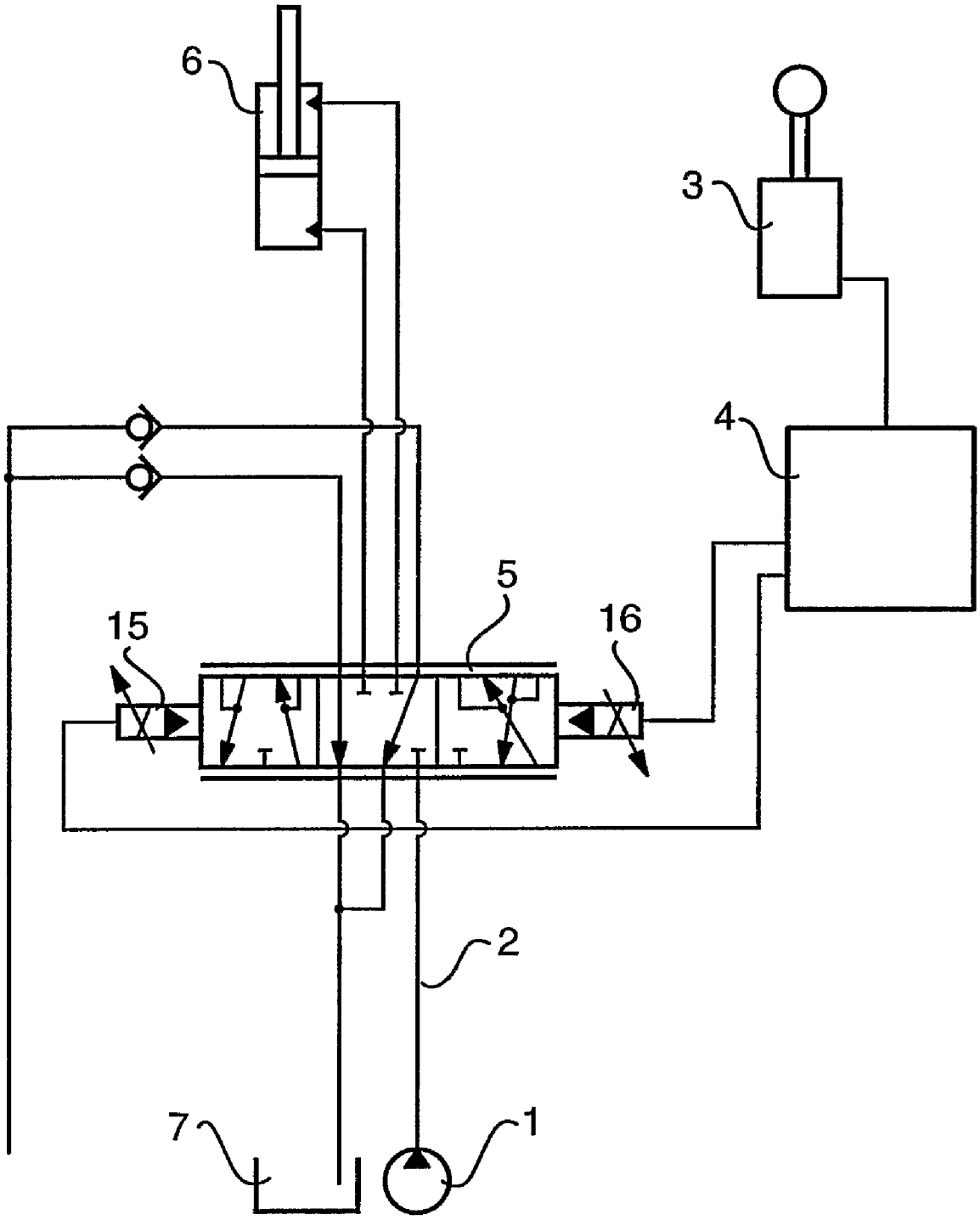
FIG. 1 is a circuit diagram for a device according to the invention.

FIG. 1 is a schematic representation of a circuit diagram for a device for implementing the method according to the invention. The device includes a source of pressurized fluid 1, for example an oil pump, a circuit of pressurized fluid 2 consisting of, e.g., lines for conducting the pressure fluid. Furthermore, the device includes a control member 3, preferably a control lever, a control unit or computer 4, a valve 5 and a hydraulically driven cylinder-piston unit 6 for direct control of a work implement (not shown). The device also includes a tank 7, constituting a low-pressure side of the hydraulic circuit 2. Furthermore it should be appreciated that additional components, which normally are present in a hydraulic circuit, can be included in the device. For instance, the valve 5 is precontrolled by an electrically controlled hydraulic pressure reducer (solenoid) 15,16.

Advantageously, the device for implementing the invention is arranged on a working machine for controlling a work implement of the machine. According to a preferred embodiment, the machine is a loading machine such as a front end loader, wherein the work implement is such that there is a need to operate it smoothly in normal operation and that there is a need to operate it more abruptly on certain occasions, that is to say to achieve rapid, abrupt movements of the implement. Typically the implement is a bucket on which it is desired, by means of manual commands issued by an operator, to implement a bucket shaking function by means of the device according to the invention at the same time as a smooth operation is ensured in normal operation.

The device functions in such a way that an operator, for example a driver being positioned in the cabin of a loading machine, generates signals, preferably electric ones, by means of manipulating the control member 3 which in this case is arranged in said cabin, which signals via the control unit 4 are passed on to the valve 5 in order to control it. Normally, the control unit 4 is arranged for manipulating the signals, or determining predetermined sets of control parameters, in order to achieve one out of two operating modes, smooth mode operation or abrupt mode operation, of the work implement. For this purpose, the control unit 4 is equipped with software including one control algorithm, or control module, for smooth mode operation, and one algorithm, control module, for abrupt mode operation. It may also be looked upon as the control unit including two given sets of control parameters, one for smooth mode operation and one for abrupt mode operation, or a set of control parameters which is changed when switching from one operating mode function to the other. Advantageously, the control member 3 is arranged in such a way that a signal can be generated via it by the operator in order to select one of the operating mode functions, or to select one of the modules. As a rule, abrupt mode operation is selected in this way, since smooth mode operation is the one that normally comes into force automatically.

Several methods are proposed for selecting operating mode module/operating mode function. Amongst these, the following should be mentioned in particular: the control member is a control lever and the operator pulls this back and forth a number of times over a certain frequency level, wherein this is detected by the control unit 4 and the latter generates a switch-over to abrupt mode operation; the device includes a pressure button being connected to the control unit 4, wherein the abrupt mode module is activated; the device includes a pressure button being connected to the control unit 4, wherein the abrupt mode module becomes activated as long as the control lever is used actively; the device includes a pressure button being connected to the control unit 4. The abrupt mode module is activated only as long as the button is depressed; the device includes a pressure button being connected to the control unit 4 which, in its turn, emits control signals itself which correspond to the lever being pulled back and forth when the button is depressed.

Figure 2:
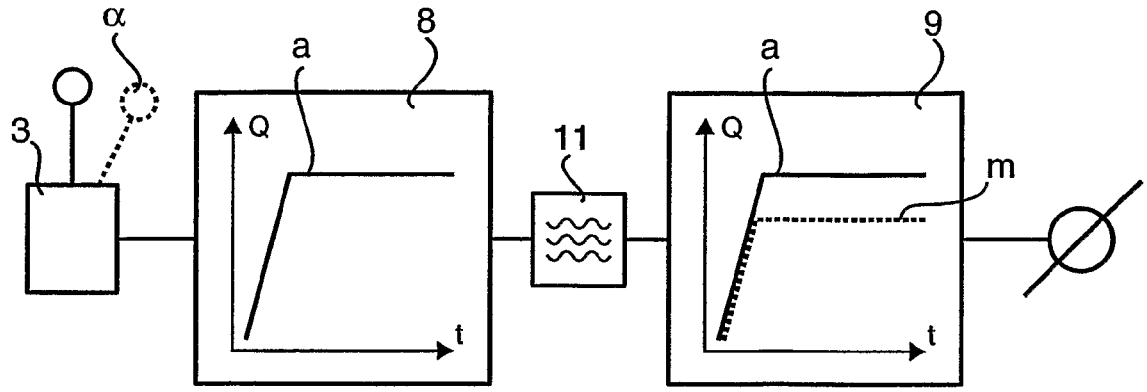
FIG. 2 is a diagram that shows the relationship between flow through the hydraulic valve and time, for abrupt mode module and smooth mode module.
Figure 3:
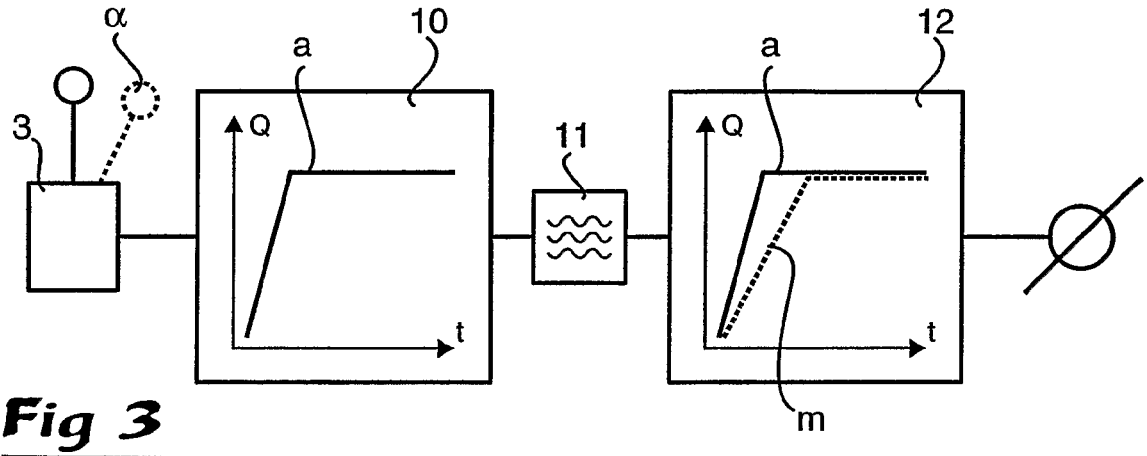
FIG. 3 is a diagram which shows the relationship between flow through the hydraulic valve for abrupt mode module and smooth mode module according to one embodiment of the present invention.
Figure 4:
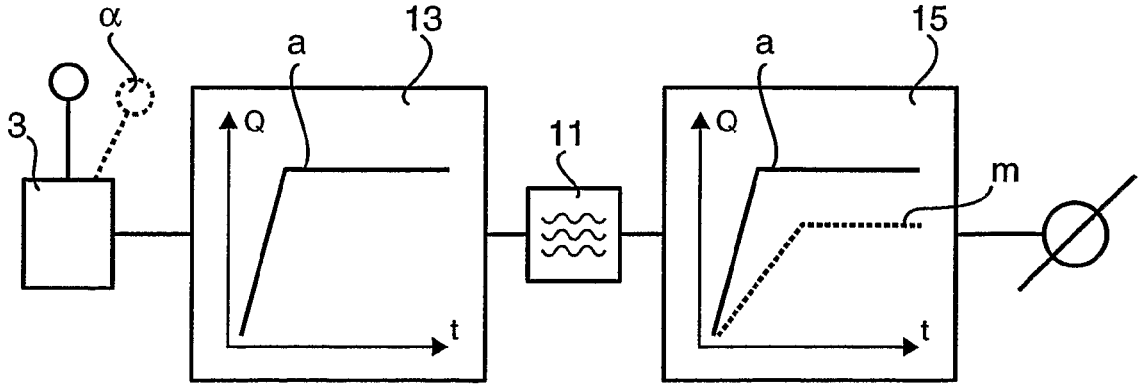
FIG. 4 is a diagram that shows the relationship between flow through the hydraulic valve and time abrupt mode module and smooth mode module according to an alternative embodiment of the present invention.

FIGS. 2-4 show different ways of implementing abrupt mode operation. FIG. 2 is a diagram for a known device from which it is evident that a switch over to abrupt mode operation results in the control lever characteristics being changed in so far as a given control lever position results in another opening degree of the valve being controlled and determining the flow of pressure fluid to a cylinder-piston unit of a device of the type described in the foregoing and shown in FIG. 1. However, when considered as a change of opening area per time unit, the speed at which the valve is opened is the same for both operating modes. In other words, there are variable control lever characteristics or variable signal characteristics, depending on how one wants to look upon it. In box 8 in FIG. 2 the flow, or the valve opening degree if you like, is shown plotted against time for a basic set of control parameters. In operation, a filter function, being depicted with box 10 and implemented by the control unit 4, will be applied to the basic set of control parameters. Flow-time curves for smooth mode operation (m) and abrupt mode operation (a), respectively, are shown in box 9. As is evident, the ramp time, that is to say the time for opening the valve 5 to the opening degree which corresponds to a given control lever displacement (α), is not changed, but remains the same for the abrupt mode function (a) and the smooth mode function (m).

FIG. 3 shows a first example of the principle of the method according to the invention, according to which the same control lever characteristics apply to the smooth mode function and to the abrupt mode function. In other words, the same maximum valve opening degree is maintained both in smooth mode operation (m) and in abrupt mode operation (a). Like box 8 in FIG. 2, box 10 shows a curve for a basic set of control parameters, with a given time constant or ramp for the valve 5 opening. A filter function, being implemented by the control unit 4, is depicted by box 11. Depending on whether smooth mode operation (m) or abrupt mode operation (a) is ordered, the filter will function in different ways, which is evident from FIG. 12, in which the curves for abrupt mode operation a and smooth mode operation m, respectively, have been plotted. The ramp time, that is to say the time constant for the valve opening, is shorter in abrupt mode operation a than in smooth mode operation (m). In other words, the control parameters, more precisely the time constant, are changed when switching from one operating mode to the other. Basically, the device is fast, that is to say, gives a rapid basic response, corresponding to abrupt mode operation. Therefore, in smooth mode operation with the smooth mode module, the control unit 4 normally manipulates the signals from the control member/lever 3 by means of a signal filter or a dynamic filter 11. This is done in order to achieve a smooth operation with long ramp times in normal operation, for example digging or loading with a bucket. Accordingly, when switching to abrupt mode operation, the application of the filter 11 or the filtration of the control signals are eliminated or reduced. Accordingly, the abrupt mode module works with a reduced or eliminated filtration of the control signals from the control member 3.

FIG. 4 shows a second example of the principle of the method according to the invention. This embodiment is a combination of the principle with changed control lever characteristics which has been proposed in the prior art and the principle according to the invention, that is to say with different ramp times for abrupt mode operation and smooth mode operation. This combination is probably the most favorable solution for most hydraulic circuits being adapted to operate according to the invention, for example for controlling a bucket and implementing a bucket shaking function. In box 13, flow against time are shown for a basic set of control parameters, whereas the corresponding curves for abrupt mode operation a. and smooth mode operation (m) are shown in box 15. Smooth mode operation (m) implies that a basically slower operation with smaller control lever displacement response, as far as the valve opening degree is concerned, is used in combination with a longer ramp time, which in this case, as in the previous embodiment, is achieved by means of a filter, depicted by box 11. In abrupt mode operation a, there is in principle no limitation or change of the parameters which determine the maximum opening degree and the time constant (the ramp), respectively, by comparison with the basic set being indicated in box 13.

It should be appreciated that variants of the invention will be obvious to a skilled person within the field without departing from the scope of the invention, as it is defined in the appended claims with support from the description and the appended drawings.

In particular, different types and combinations of different types of signal filtration will be possible within the scope of the invention. The signals can be analogue or digital.

It is also conceivable that the pressure over the valve 5 is increased when switching to abrupt mode operation, for example by means of allowing the pump 1 to deliver a higher pressure in relation to the load in abrupt mode operation than in normal conditions (soft mode operation). This can be done either by means of changing the output of the pump 1 or by means of controlling a pressure regulator, suitably being located upstream the valve 5.

It should be appreciated that the expression operating mode function, as used herein, can be replaced with equivalent expressions such as "mode of operation", "method of working", "working principle", etc.

What is claimed is:

1. A working machine comprising:

a source of pressurized fluid (1);

a circuit of pressurized fluid (2) for driving the work implement;

an electronically controlled hydraulic valve (5) arranged in the circuit of pressurized fluid (2) for controlling the function of the work implement; and a computer-based control unit (4), with machine-executable program statements thereon, that controls the hydraulic valve (5) based upon a signal from a control member (3) for transmitting a control command to the control unit (4), wherein the control unit (4) alternately controls the hydraulic valve (5), using a filter function to do so, in accordance with a smooth mode function or an abrupt mode function and wherein the filter function operates differently in the smooth mode and in the abrupt mode so that the opening time for opening the hydraulic valve (5) to a predetermined opening degree is changed when switching from one operating mode function to the other operating mode function, the ramp time for the hydraulic valve (5) to open to said predetermined degree being shorter in the abrupt mode than in the smooth mode.

2. The working machine as recited in claim 1, wherein the opening time for opening the hydraulic valve (5) to a predetermined opening degree is reduced when switching from smooth mode function to abrupt mode function.

3. The working machine as recited in claim 1, wherein the maximum opening degree of the hydraulic valve (5) is changed when switching from one operating mode function to the other.

4. The working machine as recited in claim 3, wherein the opening degree of the hydraulic valve (5) corresponding to a given position of the control member (3) is changed when switching from one operating mode function to the other.

5. The working machine as recited in claim 3, wherein the opening degree is increased when switching from the smooth mode function to the abrupt mode function.

6. The working machine as recited in claim 1, wherein the control member (3) is a control lever, being adapted to be brought manually from a starting position to a displacement angle (α), and wherein the opening degree of the hydraulic valve (5) is determined by the displacement angle (α).

7. The working machine as recited in claim 1, wherein the selection of operating mode function is made by the control unit (4) based upon the speed or frequency at which the control member (3) is moved back and forth by an operator.

8. The working machine as recited in claim 1, wherein the pressure level, being supplied by the source of pressurized fluid (1) for driving the work implement is increased when switching from smooth mode function to abrupt mode function.

9. The working machine as recited in claim 1, wherein said working machine includes a tiltable bucket.

10. A method for controlling a function of a work implement by means of a device including a source of pressurized fluid (1), a circuit of pressurized fluid (2) for driving the work implement, an electronically controlled hydraulic valve (5) arranged in the circuit of pressurized fluid (2) for controlling the function of the work implement, and a control unit (4), said method comprising:

controlling the hydraulic valve (5) based upon a signal from a control member (3) for transmitting a control command to the control unit (4), said control unit (4) alternately controlling the hydraulic valve (5), using a filter function to do so, in accordance with a smooth mode function or an abrupt mode function wherein the filter function operates differently in the smooth mode and in the abrupt mode so that the opening time for opening the hydraulic valve (5) to a predetermined opening degree is changed when switching from one operating mode function to the other operating mode function, the ramp time for the hydraulic valve (5) to open to said predetermined degree being shorter in the abrupt mode than in the smooth mode.

11. The method as recited in claim 10, wherein the opening time for opening the hydraulic valve (5) to a predetermined opening degree is reduced when switching from smooth mode function to abrupt mode function.

12. The method as recited in claim 10, wherein the maximum opening degree of the hydraulic valve (5) is changed when switching from one operating mode function to the other.

13. The method as recited in claim 12, wherein the opening degree of the hydraulic valve (5) corresponding to a given position of the control member (3) is changed when switching from one operating mode function to the other.

14. The method as recited in claim 12, wherein the opening degree is increased when switching from the smooth mode function to the abrupt mode function.

15. The method as recited in claim 10, wherein the control member (3) is a control lever adapted to be brought manually from a starting position to a displacement angle ($\alpha$), wherein the opening degree of the hydraulic valve (5) is determined by the displacement angle ($\alpha$).

16. The method as recited in claim 10, wherein the selection of operating mode function is made by the control unit (4) based upon the speed or frequency at which the control member (3) is moved back and forth by an operator.

17. The method as recited in claim 10, wherein the pressure level being supplied by the source of pressurized fluid (1) for driving the work implement is increased when switching from smooth mode function to abrupt mode function.

18. The method as recited in claim 10, wherein said method is applied to a loading machine the work implement is a tiltable bucket, and that the operating function is a bucket tilt function.

19. The method as recited in claim 10, wherein said method is executed by machine-executable program statements residing on a computer-based control unit.

* * * * *